United States Patent [19]

Kojima et al.

[11] 4,279,501

[45] Jul. 21, 1981

[54] CLEANING DEVICE FOR PHOTOELECTROSTATIC COPYING APPARATUS

[75] Inventors: Kenji Kojima; Sakae Ota, both of Tokyo; Akio Katsumata, Chigasaki; Toshiaki Kameyama; Toshio Watanabe, both of Yokohama; Tadao Koike, Tokyo, all of Japan

[73] Assignee: Ricoh Company, Ltd., Japan

[21] Appl. No.: 36,736

[22] Filed: May 7, 1979

Related U.S. Application Data

[63] Continuation of Ser. No. 861,401, Dec. 16, 1977, abandoned.

[30] Foreign Application Priority Data

Dec. 29, 1976 [JP] Japan ..... 51-160155

[51] Int. Cl.³ ..... G03G 21/00

[52] U.S. Cl. ..... 355/15; 15/256.52; 118/652

[58] Field of Search ..... 355/15; 15/1.5, 256.5, 15/256.51, 256.52; 118/652; 134/1

[56] References Cited

U.S. PATENT DOCUMENTS

| | | | |
|---|---|---|---|
| 3,526,457 | 9/1970 | Dimond et al. | 355/15 |
| 3,792,925 | 2/1974 | Milligan | 355/15 |
| 3,848,993 | 11/1974 | Hasiotis | 15/1.5 R |
| 4,032,229 | 6/1977 | Tani et al. | 355/15 |
| 4,131,359 | 12/1978 | Honda | 118/652 |

FOREIGN PATENT DOCUMENTS

| | | | |
|---|---|---|---|
| 2600496 | 8/1976 | Fed. Rep. of Germany | 355/15 |

*Primary Examiner*—William H. Beha, Jr.
*Attorney, Agent, or Firm*—McGlew and Tuttle

[57] ABSTRACT

A cleaning device for a photoelectrostatic copying apparatus has a cleaning blade and a cleaning roller adapted to be brought into pressing engagement with a photosensitive member to effect cleaning thereof after transfer printing. The cleaning blade is brought out of contact with the photosensitive member and the cleaning roller is either brought out of contact with the photosensitive member or has its contact pressure reduced when the apparatus is inoperative, whereby damage to the photosensitive member due to the pressing engagement of the photosensitive member with the blade and the roller can be avoided or minimized.

4 Claims, 5 Drawing Figures

CLEANING DEVICE FOR PHOTOELECTROSTATIC COPYING APPARATUS

This is a continuation of application Ser. No. 861,401 filed Dec. 16, 1977 now abandoned.

FIELD AND BACKGROUND OF THE INVENTION

This invention relates to a cleaning device for cleaning a photosensitive member of a photoelectrostatic copying apparatus after an electrostatic latent image formed on the photosensitive member is developed into a visible image by means of a developing agent and the visible image is printed on a copy sheet by transfer printing.

In a cleaning device of the type described for a photoelectrostatic copying apparatus, it is well known that a blade is used as a cleaning member for cleaning the surface of the photosensitive member. If the blade is of a type which is maintained in pressing contact with the surface of the photosensitive member at all times, the portion of the surface of the photosensitive member with which the blade is maintained in contact tends to be damaged. Such damage, once caused on the surface of the photosensitive member, will be responsible for the production of unacceptable copies in which the image formed are defective and not suitable for use. For example, when the original has a solid black image of a large area, a copy produced from such original by using the damaged photosensitive member will have transversely directed white streaks in the black image; when the original consists of an image having a large proportion of white regions, a copy produced will have black streaks therein. It is believed that such damage is attributed to the development of viscosity in the selenium layer with which the photosensitive member is coated, due to the fact that the temperature at which the cleaning blade contacts the selenium layer of the photosensitive member is about 35° C. which is the transformation point of selenium. The production of white or black streaks in the copied images caused by the use of the damaged photosensitive member can be considered to be due to the following factors.

In the case of an original consisting of an image of high density, that is, a high surface potential of the photosensitive member, the damaged regions of the photosensitive member will have a reduced thickness in the selenium layer, with the result that the damaged regions have a lower electric potential than the surrounding normal regions. Also, gaps will be formed between the copy sheet and the damaged regions of the photosensitive member when transfer printing of the visible image is carried out. These factors are believed to be responsible for the development of white streaks in the copied image.

Another factor concerned in this phenomenon is thought to be the crystallization of selenium forming the surface layer of a photosensitive member. Generally, changes in the temperature of a substance are caused by heat transfer or deformation to which the substance is subjected. In the case of a cleaning blade for a photosensitive member, the pressure at which the cleaning blade contacts the surface of the photosensitive member is almost constant. However, the selenium layer of the photosensitive member will become viscous when the temperature at which the cleaning blade is maintained in contact with the selenium layer reaches a certain level, resulting in local distortion of the surface of the photosensitive member. This will cause local generation of heat due to heat transfer and deformation to which the surface of the photosensitive member is subjected, resulting in changes in temperature in the affected regions. The changes in temperature cause sudden crystallization of selenium in the affected regions of the photosensitive member. If the photosensitive member has crystallized regions in its selenium layer and the image of an original has an overall high density, the crystallized regions will have a lower electric charge than the surrounding regions when the photosensitive member is electrically charged, so that white streaks will be produced in a copied image. When the image of an original has an overall low density, the presence of crystallized regions in the selenium layer reduces the damping sensitivity of the electric potential of such regions to the light projected thereon and causes the electric potential of these regions to become higher than that of the surrounding regions, thereby producing black streaks in a copy made from the original.

When the developing agent used is in a liquid state, the collection of the developing liquid in the damaged regions of the photosensitive member causes the production of undesirable streaks in a copied image. In the case of an original consisting of an image of an overall low density, the developing liquid collected in the damaged regions will perform the same function as a filter when the photosensitive member is exposed to an optical image of the original, so that the electric potential of the damaged regions become higher than the surrounding regions due to a delay in the reduction of electric potential of these regions. This produces black streaks in a copy made from the original.

It would be proper to consider that the aforementioned factors are not isolated from each other but rather work together in bringing about the production of black or white streaks in the image of a copy produced by using a photosensitive member having damaged regions in its surface.

In the art of photoelectrostatic copying, it is also well known that a cleaning roller made of a resilient material is arranged anterior to the cleaning blade with respect to the direction of rotation of the photosensitive member and maintained in contact with the latter for effecting preliminary cleaning thereof. Since the cleaning roller is maintained in contact with the photosensitive member at all times, the same problem as encountered with regard to the cleaning blade is encountered with regard to the cleaning roller.

SUMMARY OF THE INVENTION

This invention has as its object the elimination of the aforementioned disadvantages of a cleaning device having a cleaning blade and a cleaning roller for a photoelectrostatic copying apparatus.

According to the invention, in a cleaning device for a photoelectrostatic copying apparatus which has a cleaning blade and cleaning roller adapted to be brought into pressing engagement with a photosensitive member to effect cleaning thereof immediately after a visible image has been printed therefrom on a copy sheet by transfer printing, the aforementioned object is accomplished by providing means for bringing the cleaning blade out of contact with the photosensitive member and bringing the cleaning roller out of contact with the photosensitive member or reducing the intensitity of pressure at which the cleaning roller is maintained in contact with the photosensitive member when the apparatus is inoperative.

Other and additional objects, features and advantages of the invention will become apparatus from the description set forth hereinafter when considered in conjunction with the accompanying drawings, in which:

DETAILED DESCRIPTION

Figure 1:
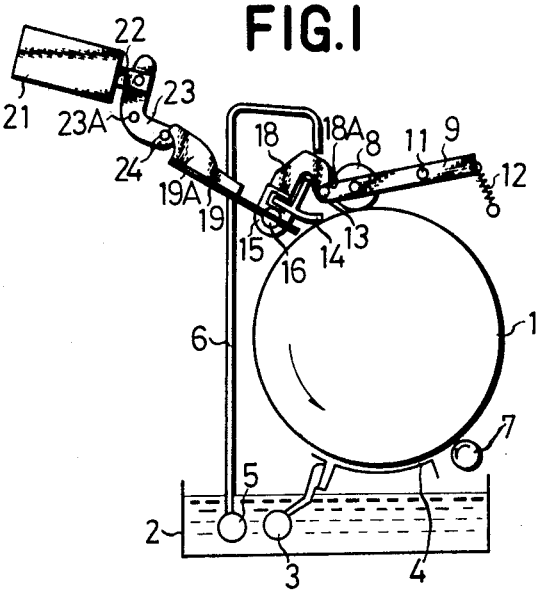
FIG. 1 is a schematic view of a photoelectrostatic copying apparatus incorporating therein the cleaning device according to the invention.
Figure 2:
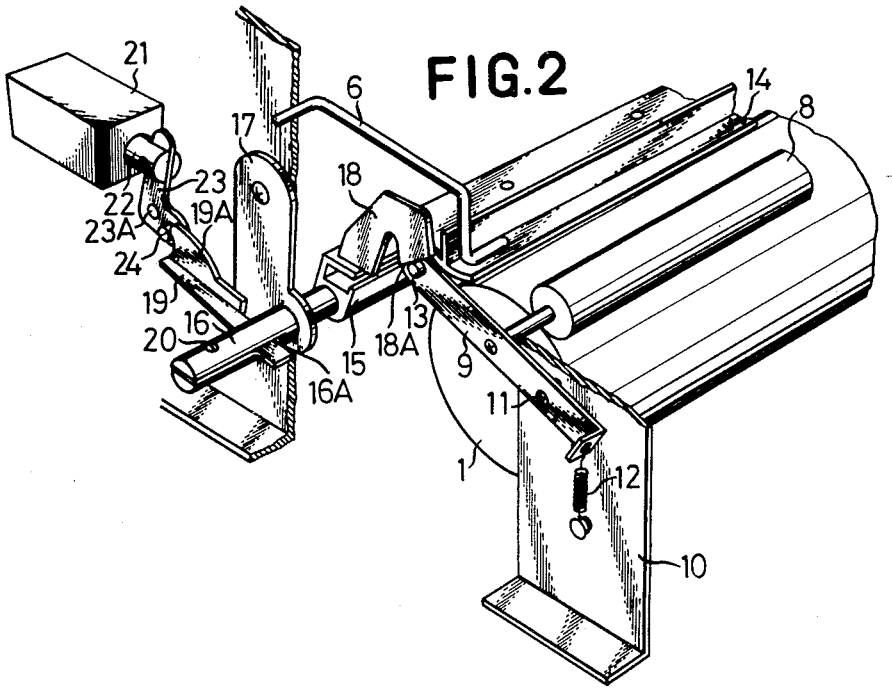
FIG. 2 is a perspective view of the essential portions of the photoelectrostatic copying apparatus shown in FIG. 1.

In FIGS. 1 and 2, a photosensitive drum 1 rotates in the direction of an arrow while in operation. Disposed below the photosensitive drum 1 is a developing liquid tank 2 containing a developing liquid which is supplied by means of a pump 3 to a trough-shaped developing electrode 4 and by means of a pump 5 to a cleaning station, subsequently to be described, through a conduit 6. The developing liquid supplied to the developing electrode 4 performs the function of converting an electrostatic latent image formed on the photosensitive drum 1 into a visible image. The numeral 7 designates a squeezing roller arranged posterior to the developing electrode 4. As is well known, charging, exposing, transfer-printing and other stations are located around the photosensitive drum 1 in addition to the aforesaid developing station. However, since these stations do not form a part of the invention, they are not shown in the drawings and a cleaning station will only be shown as being located above the photosensitive drum 1.

In the cleaning station, a cleaning roller 8 made of foamed polyurethane rubber is rotatably supported by a support lever 9 which is in the form of a two-arm lever pivotally supported by a side plate 10 through a support shaft 11. A tension spring 12 is mounted between the end of an arm opposite to an arm which supports the cleaning roller 8 and a pin attached to the side plate 10. The spring 12 normally urges the support lever 9 to pivotally move clockwise about the support shaft 11 in the figure by its biasing force. A pressing pin 13 is attached to the end of the arm of the support lever 9 which supports the cleaning roller 8. Arranged posterior to the cleaning roller 8 with respect to the direction of rotation of the photosensitive drum 1 is a cleaning blade 14 which is fixedly supported by a blade support member 15 having a rotatable shaft 16 extending outwardly from either end thereof. The rotatable shaft 16 shown in FIG. 2 is rotatably supported by a blade support side plate 17 detachably attached to the side plate 10. The blade support member 15 has fixedly secured thereto a pressure applying lever 18 formed with a shoulder 18A against which the pressing pin 13 of the support lever 9 is positioned.

The rotatable shaft 16 shown in FIG. 2 is formed with an axial cut 16A extending axially from its forward end and having fitted therein a blade rotating lever 19 for free movement. The blade rotating lever 19, which is pivotally movable about a support shaft 20 attached to the forward end portion of the rotatable shaft 16, is in the form of a three-arm lever including a first arm pivotally connected to the support shaft 20, a second arm inserted in the axial cut 16A and a third arm formed with a riser 19A. A solenoid 21 has a plunger 22 having pivotally connected thereto one end of a solenoid lever 23 which has attached to the other end thereof a pin 24 which engages a free end of the riser 19A of the third arm of lever 19. The numeral 23A designates a pivot of the solenoid lever 23.

Figure 3:
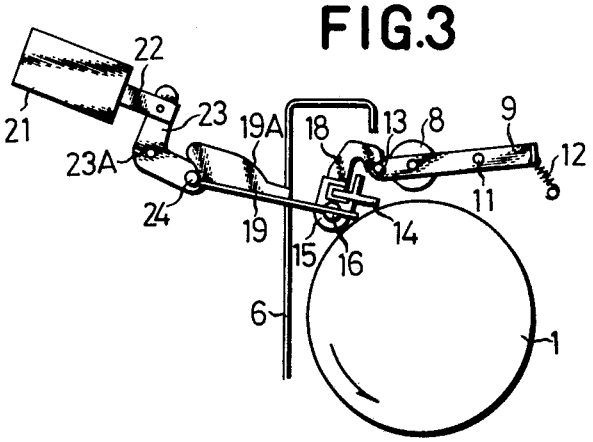
FIG. 3 is a schematic view of the cleaning device, showing the cleaning blade and the cleaning roller in positions in which they are spaced apart photosensitive drum.
Figure 4:
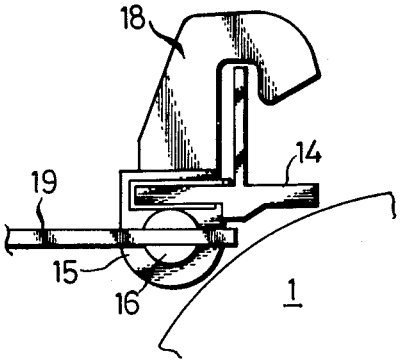
FIG. 4 is an enlarged view showing the cleaning blade in a position in which it is spaced apart from the photosensitive drum.

Upon the apparatus being switched off, the photosensitive drum 1 stops rotating and the pumps 3 and 5 are rendered inoperative, so that the supply of the developing agent in liquid form to the developing electrode 4 and the supply of the developing liquid as a cleaning liquid to the cleaning station are terminated. At this time, no current is passed to the solenoid 21, so that the plunger 22 projects outwardly as shown in FIG. 3 and the solenoid lever 23 angularly rotates clockwise about the pivot 23A. This causes the pin 24 to move downwardly. Since the support blade 15 and the blade rotating lever 19 are under the influence of the spring 12 through the support lever 9 and the pressing pin 13, the riser 19A of the blade rotating lever 19 moves downwardly as the pin 24 moves downwardly as aforesaid. Thus the blade support member 15, and hence the cleaning blade 14 and the pressing lever 18, are caused, through the rotatable shaft 16, to angularly rotate counterclockwise. At this time, the pressing pin 13 moves upwardly as the pressure applying lever 18 rotates counterclockwise, with a result that the support lever 9 is pivotally moved clockwise about the support shaft 11 by the biasing force of the spring 12. Thus the cleaning blade 14 and the cleaning roller 8 are both out of contact with the photosensitive drum 1 as shown in FIG. 3. FIG. 4 shows, on an enlarged scale, the relative positions of the cleaning blade 14 and the photosensitive drum 1 which are out of contact with each other.

Figure 5:
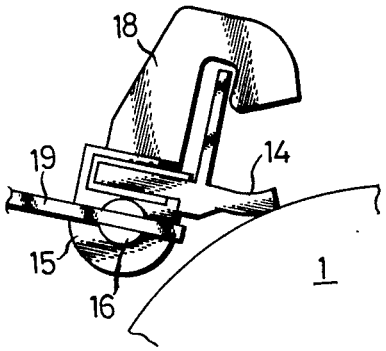
FIG. 5 is an enlarged view showing the cleaning blade being in pressing contact with the photosensitive drum.

If a main switch, not shown, is depressed to turn on the copying apparatus, a current is passed to the solenoid 21 which is energized and withdraws the plunger 22 thereinto. Accordingly the cleaning blade 14 and the cleaning roller 8 are brought into contact with the surface of the photosensitive drum 1 through a process which is reversed to the process described hereinabove, and the developing liquid is supplied to the cleaning station through the pump 5 and conduit 6. The photosensitive drum 1 rotates in the direction of the arrow, and cleaning roller 8 carries out preliminary cleaning of the surface of the drum 1 immediately after the visible image has been printed therefrom on a copy sheet by transfer printing. Then, as shown in FIG. 5, the surface of the drum 1 is cleared of the residual toner particles by the cleaning blade 14 which is in pressing contact with the surface of the drum 1, the toner particles thus collected together being carried away from the cleaning station by the developing liquid supplied from the developing liquid tank 2. If the main switch is manipulated to turn off the copying apparatus, the current passed to the solenoid 21 is interrupted as aforesaid, so that the cleaning blade 14 and the cleaning roller 8 are brought out of contact with the photosensitive drum 1 again.

From the foregoing description, it will be appreciated that the cleaning device according to the present invention is capable of satisfactorily carrying out cleaning of the surface of the photosensitive member by means of the cleaning blade which is brought into pressing engagement with the photosensitive member while the apparatus in operation, and that the cleaning blade is brought out of contact with the photosensitive member when the apparatus is rendered inoperative. Accordingly the cleaning device in accordance with the invention causes no or little damage to the surface of the photosensitive member and minimizes the possibilities of defective copies being made from originals. Also, when the photosensitive member or photosensitive drum, for example, is mounted in or removed from the apparatus for servicing or replacement, the cleaning blade is out of contact with the surface of the drum, so that no damage will be caused to the photosensitive drum by the cleaning blade on such occasions.

What is claimed is:

1. An improved cleaning device for photoelectrostatic copying apparatus of the type having a rotatable drum having a photosensitive curved peripheral surface, means for delivering liquid developer to the surface for developing an image which may be thereon to make a copy on a copy sheet, and a cleaning blade and a cleaning roller adapted to be brought into pressing engagement with the drum immediately after a visible image has been printed thereon on a copy sheet comprising, in combination, a support, a roller support lever pivotally mounted on said support, the cleaning roller being rotatably mounted on said support lever and engageable with said drum, spring means acting on said support lever to bias said support lever and the cleaning roller in a direction away from the drum, a support shaft rotatably mounted on said support alongside said roller support lever, a pressure lever on said support shaft having a portion acting on said support lever to urge it in a direction against the bias of said spring means to cause said support lever to be moved into engagement with the drum, the cleaning blade being connected to said shaft and engageable on the drum with the cleaning roller in an operative cleaning position in contact with the drum responsive to the operation of the photoelectrostatic apparatus after the visible image has been transferred therefrom to make a copy, actuating means having a driven member selectively acting on said shaft for maintaining contact of the cleaning blade and cleaning roller on the drum for cleaning responsive to the operation of the apparatus after the visible image has been transferred therefrom to make a copy and permitting said support shaft to rotate in a direction to lift the cleaning blade out of contact with the drum by the bias of said spring means and to position the cleaning blade out of contact with the drum and to position the cleaning roller in one of a position out of contact with the drum and a position in which its contact pressure with the drum is reduced when the apparatus is not operating.

2. The improvement of claim 1, wherein said actuating means comprises a solenoid, said driven member comprises a plunger movable in said solenoid.

3. An improvement according to claim 2, further comprising a blade rotating lever connected to said support shaft, a riser on said blade moving lever, a solenoid lever pivotally mounted to the support having one end engaged with said riser and an opposite end connected to said plunger.

4. An improved photoelectric copying apparatus of the type having a photosensitive drum rotatably mounted in the apparatus for rotary movement, first and second cleaning means extending across the drum operable for movement between a first position in contact with the drum at spaced locations for cleaning the drum immediately after a visible image has been printed therefrom on a copy sheet and a second position in which at least one of the cleaning means is out of contact with the drum, means for movably biasing the first and second cleaning means into contact with the drum, lever means connected to the first cleaning means operable for moving the first and second cleaning means, the improvement comprising actuator means for selectively engaging the lever means operable, responsive to an energizing signal, to move the first and second cleaning means between the first position and the second position, said first cleaning means comprising a cleaning blade, a blade support member for supporting said cleaning blade rotatably mounted to the apparatus for bringing the cleaning blade into and out of pressing engagement with the drum, said blade support member being controlled in its angular rotation by said lever means, and said second cleaning means comprises a cleaning roller, a lever for rotatably supporting said cleaning roller, said first cleaning means and said second cleaning means operatively connected with each other in such manner that, as said cleaning blade is brought into and out of contact with the drum, the cleaning roller is positioned in one of a first position out of pressing engagement with the drum and a second position in which its contact pressure with the drum is reduced.

* * * * *